United States Patent [19]

Haight

[11] 4,206,046

[45] Jun. 3, 1980

[54] PROCESS AND APPARATUS FOR SEPARATING PARTICLES BY RELATIVE DENSITY

[76] Inventor: William J. Haight, 5 Ridgeview Dr., Pleasantville, N.Y. 10570

[21] Appl. No.: 4,602

[22] Filed: Jan. 18, 1979

Related U.S. Application Data

[60] Division of Ser. No. 854,950, Nov. 25, 1977, Pat. No. 4,148,725, which is a continuation-in-part of Ser. No. 663,247, Mar. 2, 1976, abandoned, which is a continuation-in-part of Ser. No. 552,704, Feb. 24, 1975, abandoned.

[51] Int. Cl.[2] ..... B07B 13/00

[52] U.S. Cl. ..... 209/481; 209/485

[58] Field of Search ..... 209/479–481, 209/471, 472, 434–436, 444, 438, 439, 445, 453, 332, 366.5, 504, 485

[56] References Cited

U.S. PATENT DOCUMENTS

| | | | |
|---|---|---|---|
| 561,355 | 6/1896 | Sperry | 209/435 |
| 944,917 | 12/1909 | Scott | 209/444 |
| 987,866 | 3/1911 | Earle | 209/45 |
| 1,070,695 | 8/1913 | Kellogg | 209/479 |
| 1,141,972 | 6/1915 | Muhleman | 209/439 |
| 1,286,111 | 11/1918 | Robertson | 209/435 |
| 2,563,249 | 8/1951 | Koziol | 209/270 |
| 2,950,819 | 8/1960 | Holman et al. | 209/326 |
| 3,349,904 | 10/1967 | Walker | 209/29 |
| 3,399,771 | 9/1968 | Hryniowski | 209/336.5 X |
| 3,794,165 | 2/1974 | Riesbeck et al. | 209/332 X |

FOREIGN PATENT DOCUMENTS

| | | | |
|---|---|---|---|
| 89529 | 7/1895 | Fed. Rep. of Germany | 209/480 |

OTHER PUBLICATIONS

"Sweco Vibro-Energy Separators," published by Sweco, Inc. (1973).

Denver Equipment Index, 2nd Ed., vol. 1, 1947, pp. 88–89.

*Primary Examiner*—Ralph J. Hill

*Attorney, Agent, or Firm*—Morgan, Finnegan, Pine, Foley & Lee

[57] ABSTRACT

A process and apparatus wherein a size-classified bed of particles is fluidized by agitating a supporting surface with a gyratory motion to fluidize the particle bed. Particles are contacted with surfaces, e.g, vertically projecting surfaces, movable with the supporting surface and defining two or more annular regions so as to impart sufficient fluidity to allow the particles to move within the particle bed and distribute themselves according to their relative densities. Particles are then permitted to move through openings between these annular regions whereby the more dense particles tend to accumulate in one of the annular regions and particles of lesser density are displaced into the adjacent annular region(s).

Provision is made for continuously extracting from the aggregate particle mass either or both those particles of lesser density and those of greater density whereby a continuous selective separation of particles according to density takes place. Various configurations are used to define annular regions within the particle bed and the flow of the more (or less) dense particles may be either radially inward or outward between such annular regions, depending upon the nature of the gyratory motion, and upon other factors more fully described herein, such as the dimensions of the annular regions, particle size and density and the frequency and amplitude of gyration.

4 Claims, 16 Drawing Figures

PROCESS AND APPARATUS FOR SEPARATING PARTICLES BY RELATIVE DENSITY

RELATED APPLICATIONS

This is a division of application Ser. No. 854,950 filed Nov. 25, 1977, now U.S. Pat. No. 4,148,725, which is a continuation-in-part of my earlier application Ser. No. 663,247, filed Mar. 2, 1976 and now abandoned, which in turn is a continuation-in part of application Ser. No. 552,704, filed Feb. 24, 1975 and now abandoned, all three such applications having the same title.

FIELD OF THE INVENTION

This invention relates to the separation and classification according to relative mass and/or density of particles contained in an aggregate mass of particles of various relative masses or densities. In particular, it relates to an improved process wherein gyratory motion is used to energize the particles to fluidize the particle bed. It is particularly useful in the separation of dry particulate ores and minerals, where the process can be applied to upgrading. For example, the invention readily separates dense particles, such as gold, lead or other metal particulates from less dense sand or gravel of the same particle size. The invention is especially effective in separating dense particles from a homogeneous flowable bed of particles of different density.

Known processes for separating and classifying particles contained within an aggregate particle mass are truly numerous. Many of these processes are limited to separating particles according to size (classifying) or weight while others are effective in separating particles in accordance with their densities, irrespective of the size of the particle. The present invention pertains to the latter type of separation process, but can be used in combination with the other types of separation techniques.

One of the oldest methods for separating heavier materials from lighter crushed materials is the riffle board, or riffle pan in which crushed ore, for example, is placed upon a corrugated surface set at an incline and flushed with water. During separation, the riffle board is moved back and forth in directions normal to the corrugations, or is otherwise vibrated so as to create relative motion between the particles and the riffled surface. The lighter ore tends to carry over the corrugations (riffles) farther from the point of feed than the heavier minerals, and the crushed materials therefore are carried by the water over the edge of the riffle board at different points.

A serious disadvantage in the riffle board type of separation process is its requirement for a continuous flow of fluid over the riffles and a high degree of unselectivity in attempting to separate out even the heaviest particles. In addition, the riffles are necessarily restricted in dimension and thus a limit is placed on the amount of material which may be separated in a given amount of time.

Another technique for grading crushed ore particles is found in U.S. Pat. No. 3,349,904. There a rotating screen in the form of an inverted cone receives the aggregate particle mass while air is simultaneously blown upward through the screen to create an upward pressure. Heavier metal particles are intended to overcome the upward air blast pressure and be separated out of the mass by falling through the screen, while lighter rock particles are thrown upwardly and outwardly to the periphery of the screen due to centrifugal force. The major disadvantage in attempting to separate particles by this method is the high degree of complexity of the apparatus and the essential requirement for a source of pressurized air. Another obvious limitation is that material sized larger than the screen openings, even if having the selected density, cannot be handled. Furthermore, although it may be possible to separate materials whose densities are grossly disparate, it is believed that the process is not sufficiently selective where the density of the desired material (such as crushed ore) approaches the density of the waste material unless the particle size is carefully controlled.

Processes such as that disclosed in U.S. Pat. No. 2,950,819 use a gyratory separator (or "classifier") in which the particle mass is placed upon a vibratory screen which is designed to pass particles of all sizes smaller than the screen openings and irrespective of the particles' densities. Separators of this type are usually operated to cause all over-size particles to move to the periphery of the screen and be discharged. It is possible, however, to operate such devices such that over-size particles do not discharge due to a tendency for them to move radially inwardly to the center of the screen where they are retained as is shown, for example, in U.S. Pat. No. 3,794,165 (FIGS. 7–10). In certain cases these separators are used to remove or recover particles entrained in a liquid wherein the liquid passes through the screen and the particles are trapped by the vibratory screen and flushed down an outlet at the screen's center.

In all cases, so far as is known, gyratory separators have not been adapted to or operated for separating particles in accordance with their relative densities. Even in cases where particles are retained on the vibratory screen, no provision was made for separately segregating or extracting those remaining particles according to their density.

One of the most widely used methods at present for extracting ore particles of selected density from a larger particle mass is the so-called "flotation" process. This process is a wet process because it uses water as a carrier of the ore particles. The ore is first finely crushed into powdered form and then dispersed in the water carrier while oil or some other different liquid is passed upwardly through the aqueous flotation medium. Particles, depending upon their densities, are attracted to the liquid substance and are carried off and collected.

Although the flotation process is capable of upgrading the crushed ore by a factor of 90%, while retaining 90% of all the minerals, it is usually desirable that the ore be ground into extremely small particle size, e.g., No. 400 mesh (400 particles per inch). The production cost of mining and crushing ore to a state this fine is expensive. It is known, for example, to account for almost one-half the mining and recovery costs of certain metals. Furthermore, the process is usable only where there is an ample source of water, a resource which is often unavailable in sufficient quantity for carrying out the flotation step, and it is also polluting if the water carrier waste is discharged back into the source without cleaning.

A yet more venerable separation method is gold panning, where a prospector places a small sample of placer in a shallow metal pan and gently swirls the pan to rid it of low density particles while retaining the heavier ones. This procedure is mentioned here because it is still in use by both amateurs and professionals. Panning is sometimes used in the field, for example, in order to separate gold dust from gravel cores drilled from the earth. As might be expected, panning is slow, tedious and unrewarding except for the most skilled prospectors.

Still another known separation technique is based upon a mechanical concentrator known as the Denver Mechanical Concentrating Pan which duplicates the hand panning motion. This device consists of a series of classifying screens under which are placed several pans specially coated to trap the fine heavy materials (e.g., gold). The first pan is metal coated with mercury to amalgamate free gold; the remaining pans receive the overflow from the first and are coated with a rubber matting covered with screening which acts like a riffle. The entire assembly is driven with an eccentric motion in order to swirl the material in water, which is added along with the particle mixture, to settle the mineral. Like other processes, this technique requires a flow of water and its collection capacity of the heavier fines is limited by the amalgamation and riffle capacity of the concentrating pans. It thus must be stopped periodically and emptied of the concentrated minerals.

A similar principle is used in devices such as shown in U.S. Pat. No. 1,141,972 to Muhleman, where a rotary tilting motion is imparted to a pan having a riffled floor surface. Concentrated ore is extracted from a hole in the center of the pan floor. Again, the motion of the pan is such that the waste material swirls about the edge of the pan and is discharged whereas heavier material gravitates toward the center due to the tilting.

It is an object of the present invention to provide a method for separating particles in accordance with their masses or densities and which may be carried out in a dry particle bed.

Another object of the invention is to avoid some of the disadvantages of particle separation techniques previously used, while permitting the use of uncomplex apparatus.

Yet another object of the invention is to provide novel apparatus and processes wherein particles are separated in defined annular regions in a particle bed.

Among the additional objects of the invention is to provide methods and apparatus for separating particles by efficiently converting gyratory motion into a controlled motion of particles within a particle bed. More broadly, it is an object of the invention to provide a novel way of fluidizing a dry particle bed whereby the movement and flow of particles within the fluidized bed is controlled in a way which permits segregation of particles according to relative mass or density.

SUMMARY OF THE INVENTION

These and other objects of the invention are attained by disposing an aggregated mass of particles, which may have different densities, upon a supporting surface so as to form a particle bed. The particle bed is then fluidized by agitating the surface, together with other particle-contacting surfaces, with a gyratory motion having a circularly eccentric component and a vertical vibratory component sufficient to reduce the resistance of the particle bed to a degree that the particles can move through the bed in desired directions, e.g., radially circularly and vertically.

In the disclosed embodiments, particles in different annular (or circular) regions of the bed are contacted with annular reaction surfaces (e.g., vertically extending rings) movable with the supporting surface. These annular surfaces provide areas of frictional contact with the particles sufficient to impart to them a net energy or momentum causing particles of selected density to move through restricted openings to one of the annular regions for collection or removal. This movement of the particles comprises a net circularly inward or outward movement whereby particles of selected density move via the restricted openings from one annular region to another.

The reaction surfaces may comprise, for example, one or more concentric cylindrical walls or simply a high friction or grooved portion of the supporting surface. Particles are then permitted to move across the boundary between such regions whereby the energy or momentum of, for example, the more dense particles causes them to move inwardly or outwardly to the collection region, and there displace particles of lesser density.

Similar particle action can be obtained with a vertical column wherein the particle energy and/or pressure may vary from the bottom to the top of the column, and either the more dense or less dense particles can be induced to move from lower to higher levels in the column, where they may be extracted, as is hereinafter described. One phenomenon present in the invention is the tendency of more dense particles to move to given vertical levels in the bed, and this action is taken advantage of in some modes of operation.

In accordance with other aspects of the invention, the circular motion of the particle mass is controlled and directed by elements placed in the bed in order to accommodate a continuous addition of particles to the bed while extracting the particles of selected densities. In general this motion is circular, but its direction and speed can be controlled to achieve a desired isolation of more dense particles from the less dense ones.

The process is effective for upgrading otherwise uneconomic or marginally economic particulate ores and minerals. For example, although extraction of the more dense particles in accordance with certain embodiments can result in extraction of less dense particles as well, the extracted composite mass will be substantially upgraded to a degree where further separation or recovery of the dense particles becomes commercially feasible by known techniques.

DESCRIPTION OF THE DRAWINGS

For a complete understanding of the invention, together with the further purposes and advantages thereof, reference should be made to the following detailed description of preferred embodiments, and to the drawing, wherein.

DETAILED DESCRIPTION OF PREFERRED EMBODIMENTS

In the process to be described, particles of selected density (e.g., most dense particles) contained in a mass of classified particles of various densities are separated by giving the particle mass a sufficient degree of fluidity to allow the particles to move within the bed and to distribute themselves according to their densities. Specifically, the particle bed is fluidized by agitating a supporting surface for the particle bed with a gyratory motion effective to cause particles of selected density to move in a generally circular path from one annular region to another for collection or removal. The manner in which this is achieved will be explained in the ensuing description.

When the particle bed is "fluidized", it assumes many properties of a true fluid. For example, it flows and exerts "fluid" pressure, and it may exert a positive or negative buoyant force upon submerged objects so as to create a particle flow up or down in the vertical direction. Additionally, the particle bed expands due to increased spacing between particles, thereby offering less resistance to the movement of particles through the bed and permitting a relocation of classified particles based on their densities.

Figure 1:
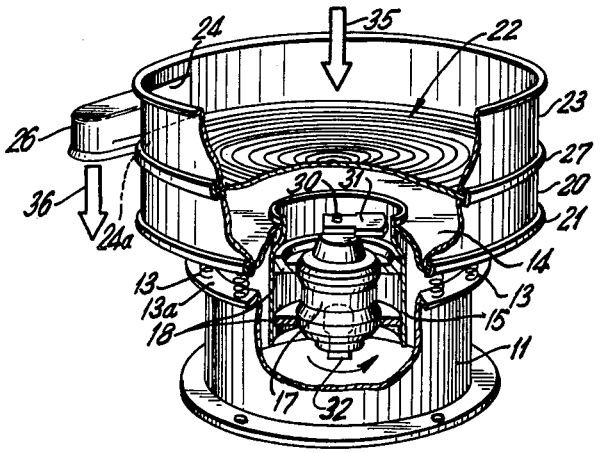
FIG. 1 is a perspective view in partial cross-section of an apparatus which may be used for carrying out the process of the invention.

Referring now to FIG. 1, the vibratory device for carrying out the process includes a cylindrical base 11 and a plurality of compression springs 13 circumferentially spaced about the upper rim 13*a* of the base for supporting a flat table 14. This table carries at its center a cylindrical motor mount 15 which extends down into the center of the base 11. The motor 17 is supported within the cylindrical motor mount 15 by a pair of annular flanges 18, such that the motor is rigidly affixed to the table 14. Vibrations induced by the motor are therefore transmitted directly to the table. A cylindrical spacing frame 20 secured by a clamping ring 21 at the periphery of the table, extends upwardly for supporting the upper section of the apparatus.

The upper section comprises a particle-supporting table 22, constructed for example of one-eighth to one-quarter inch thick steel or aluminum plating, and an upstanding cylindrical rim 23 provided with a discharge opening 24 leading to the discharge spout 26. The opening is disposed slightly above the level of the plate 22 so as to form an arcuate shoulder 24*a* preventing spill-out of any particles resting on the surface of the plate. The entire upper section is similarly clamped by the ring 27 to the rim of the lower frame 20.

A shaft 30 extends from each end of the motor to which weights 31, 32 are fixed. It will be seen that the weights project horizontally outwardly from the shaft 30, and the radial angle between the axes of the two weights is adjustable by shifting the angular position of the weight 32 on the shaft 30. In this manner, the upper weight 31 can be made to lead the position of the lower weight 32 by an adjustable angle. Adjustment of these weights alters the characteristic of the resultant vibratory motion, as is understood by those skilled in the art.

Preferably, the weight 32 is adjusted so as to provide a substantial lead angle, e.g., of about 80°–90°. This appears to bring about the maximum fluidity in the particle bed creating a sufficient weightlessness or interparticle spacing so as to minimize the resistance of the particle bed to particle movement therewithin, and to impart an upward thrust to the bed, so that particles of greater density will move upward by the absorption of greater energy than particles of lesser density. By the same token, this weight setting imparts an inward thrust, or throw, to particles contacted by the plate and the annular rim 23. On the other hand, a weight setting of 0° lead angle imparts an outward thrust to the particles on the plate, and results in less upward thrust to the particles.

The movable components of the separator assembly, as shown in FIG. 1, assume a gyratory motion, i.e., the motion has both a circularly eccentric component and an oscillatory vertical component. The combination of these two motion components enables energy imparted to the moving elements to be converted with maximum efficiency into the sought-after motion of particles placed upon the table element 22. In general, the components are sufficient in magnitude to reduce the resistance of the mass to translational movement of the particles. Increasing the lead angle of the upper weight 31 tends to increase the vertical oscillatory component of gyratory motion, as does increasing the size of the weights. Higher weight sizes also accentuate the eccentric motion displacement from center. Increasing the mass of the lower weight 32 produces a greater upward thrust and permits the use of a deeper particle bed.

In carrying out the process of the invention with the device of FIG. 1 (which will be understood is representative of the kind of device usable) together with certain additional elements to be described, particles are placed upon the table 22, as indicated by the arrow 35, and may be extracted, for example, through the opening 24 and spout 26, as indicated by the arrow 36. Other locations for extraction are also possible. Descriptions of various gyratory devices of this type, commonly referred to as separators, will be found in U.S. Pat. Nos. 3,794,165, 3,399,771 and 2,950,819.

As earlier mentioned, the circular eccentric motion combined with the vertical oscillatory motion causes the particle mass placed upon the table 22 to move radially either toward the table's center or toward the periphery, depending on the angular displacement of the eccentric weights 31 and 32. If the surface 22 were a relatively smooth one, particles could also tend to move in a slow migratory circular motion in the same direction as the eccentric motion, i.e., in the direction of revolution of the motor weights 31, 32. The particle bed, in this case, does have a certain degree of fluidity which can be enhanced and particle flow controlled by making use of the natural tendency of individual particles to spin in a direction counter to the direction of circular eccentricity, with the particle spin axis being generally normal to the supporting table 22. It has been found that this spin tendency can be converted into a circular motion of the particle mass. Moreover, the circular motion can be used to control the flow of particles within the fluidized bed.

This conversion of particle spin into a circular translational motion is accomplished by contacting the particles with a reaction surface of sufficient area. This surface may comprise surface portions at the bottom of the particle bed having components of projection normal to the plane of the surface. When the spinning surface of a particle contacts such vertical surface portions, the particles react against them and, in essence, bounce off them and thereby are given translational circular motion. The reaction surface might also and desirably will include a cylindrical wall wherein the particles react against the inner surface of the wall and are given additional energy of linear motion.

From tests conducted with vibratory devices like that depicted in FIG. 1, it appears that an efficient configuration, of the surface supporting the particle bed is one which is provided with a series of concentric grooves, scorings, or projections 40 which are contacted by the particles at the bottom of the particle bed. These grooves, scorings, or projections clearly indicated in the plan view of FIG. 2, may be spaced apart by any desired amount, the closer spacings generally giving a higher degree of fluidity to the particles. I have found that inter-groove spacings of between ¼ inch and ¾ inch provide the desired fluidization of a particle bed containing particles of between 1/16 inch and ⅛ inch in diameter. As discussed hreinafter, the reaction surface might also comprise an annular vertical surface surrounding a region of the particle bed, or a combination of annular surfaces, or an annular surface in connection with the supporting surface grooves and projections.

Figure 2:
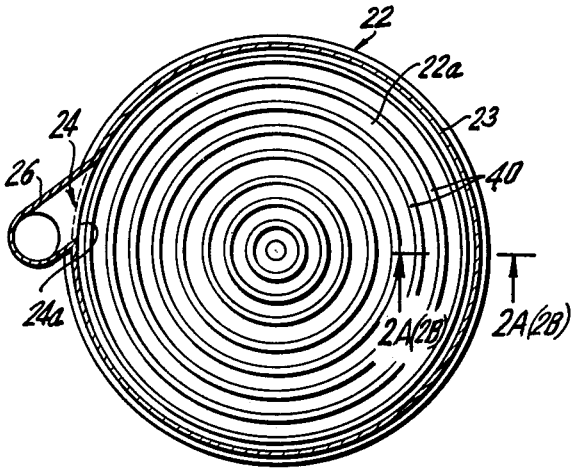
FIG. 2 is a plan section view of the FIG. 1 apparatus.
Figure 2A:
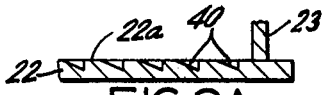
FIGS. 2A and 2B are cross-sectional views taken along the lines A, B—A,B of FIG.2.
Figure 2B:
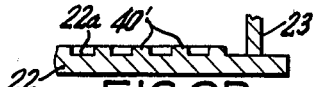

The cross-sectional view of FIG. 2A shows the shape of triangular grooves which are cut into the surface of the supporting surface 22. In the modified form of surface, seen in FIG. 2B, the particle-contacting surfaces comprise projections rising from the surface 22*a* wherein each projection has a generally rectangular cross-section with rounded upper edges.

Figure 3A:
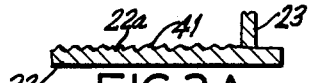
FIGS. 3A and 4A are cross-sectional views along the lines A—A in FIGS. 3 and 4, respectively.
Figure 4A:
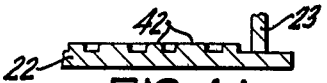
Figure 3:
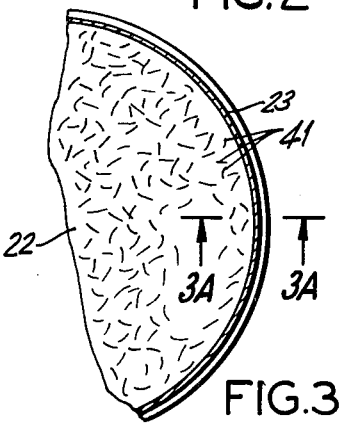
FIGS. 3 and 4 are fragmentary plan section views of the FIG. 1 apparatus showing alternative forms of its particle bed-supporting surface.
Figure 4:
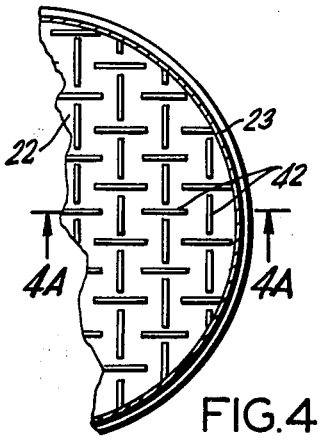

Yet another form of particle contacting projections is seen in FIGS. 3 and 3A. There, the upper surface 22*a* of the supporting table has a multitude of irregular smaller projections 41 extending upwardly. In FIGS. 4 and 4A, projections in the form of a multitude of rectangular mutually orthogonal cleats are present for contacting particles at the bottom of the particle bed and imparting to them a translational circular motion. The surface configurations of FIGS. 3, 3A and 4, 4A are not as efficient as those shown in FIGS. 2A and 2B in imparting a circular motion to the particle mass, and the rotational velocity of the particle mass on surfaces such as these is much less than the configurations of FIGS. 2A and 2B.

When an aggregate mass of particles is placed upon the supporting table 22 having the surface configuration illustrated, for example, in FIG. 2A, and with the eccentric-weights 31, 32 set for a 90° lead angle, the particle mass is given a high degree of fluidity with a strong net inward movement and accumulation of particles, as well as a circular motion counter to the direction of the eccentric component of gyration. In the embodiments described herein, for reasons which are not thoroughly understood, particles of highest relative density in a classified particle bed generally tend to move with other particles into a collection region and remain there. Particles of lesser density are displaced in that region by the highest density particles. It is believed that this region is the point of lowest total pressure. To investigate this phenomenon in more detail, reference is made to FIGS. 7–8.

Figure 7:
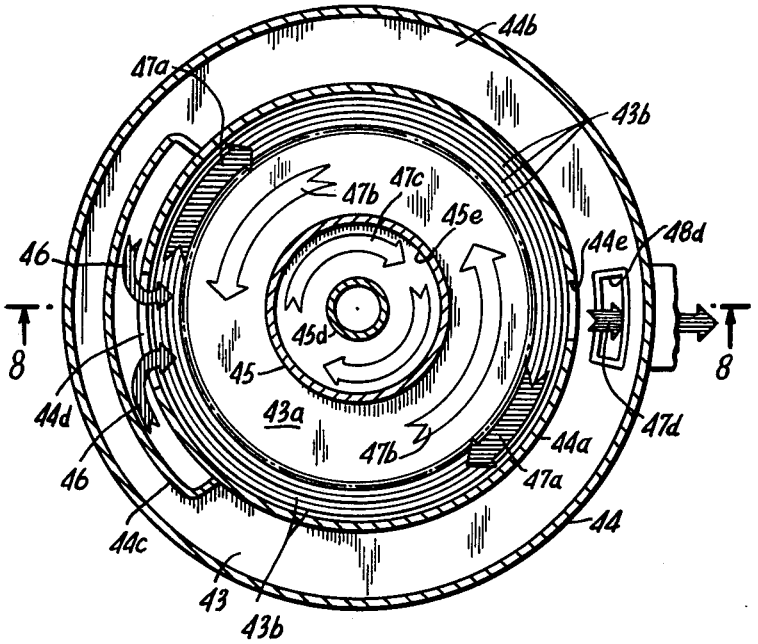
FIG. 7 is a cross-sectional plan view of an apparatus demonstrating further aspects of the process according to the invention wherein extraction of less dense particles occurs in a particle column.
Figure 8:
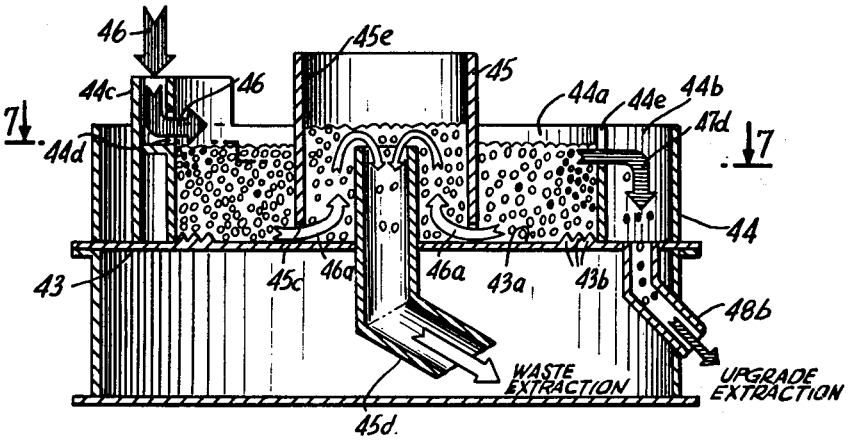
FIG. 8 is a cross-sectional elevation view of the arrangement of FIG. 7, taken along the line 8—8.

FIGS. 7–8 illustrate a basic yet effective configuration of the apparatus for carrying out the separation process of the invention. FIG. 7 is a plan view similar to FIG. 2 showing a bed supporting table element 43 and circumferential rim 44 which are understood to be affixed to the gyratory separation device of FIG. 1 in place of the elements 22, 23. The machine used in this case is one available from Russel Finex Company, Mount Vernon, New York, equipped with a 3/4 hp motor at 1140 rpm. The eccentricweights 31, 32 were set to provide for an inward "throw" of the particles.

FIG. 8 is an elevational view in cross-section of this configuration. The table surface 43*a* is optionally provided with a series of circular projections 43 *b* similar to those shown in FIG. 2A. These projections are present only in the annular region next to the rim 44 and, together with the rim, are effective to induce counter-eccentric circular motion of the particles in that region. The remaining portion of the surface 43*a* is essentially smooth, offering little frictional contact with the particles. The particles in the bed supported by this part of the table will ordinarily follow a slow circular path in the same direction of the eccentric motion component of gyration.

Another annular rim 44*a* of smaller diameter is affixed to the element 43 so as to form an annular channel 44*b* which serves as a temporary collection zone for upgraded material, as will be explained. Extending upwardly from a level adjacent the central portion of the surface 43*a* is a small annular rim, or collar, 45 which is spaced from the surface to form a narrow annular gap 45*c*, thus providing an area of limited communication between the interior and exterior of the collar. The collar 45 is affixed to the table 43 by any suitable means (as by brackets, not shown) so as to be movable therewith. Extending upwardly midway into the space at the interior of the collar is an extraction duct 45*d*, only a portion of which has been illustrated, leading to points outside the particle bed contained on the table 43. The collar provides a reaction surface 45*e* for particles at its interior so as to impart to them a counter-eccentric circular motion.

Associated with the rim 44*a* to a chute 44*c* for the introduction of raw material to be processed, indicated by the arrows 46 designating the direction of raw material flow (FIGS. 7 and 8). The chute 44*c* may be flexibly coupled to the rim 44*a* and supported externally of the agitator, if desired, to reduce imbalance of the gyratory table 43*a*. Material introduced into the chute flows through rectangular orifice 44*d* leading into the region of higher circular particle velocity in the fluidized bed of particles. Extraction of more dense particles occurs through the exit hole 48*a* and exit chute 48*b* leading from the annular collection zone 44*b*, as shown by the arrows 47*d*.

In several runs using this configuration, mixed particles containing, for example, ungraded beach sand and lead shot particles of greater size to be separated were added through the chute 44*c* to the aggregated particle mass in the annular outer region of the bed, as indicated by the shaded arrows 46. Added particles flowed onto the fluidized bed surface through the opening 44*d* in the rim 44*a*. Particles in that outer annular region of the fluidized bed were contacted by the reaction surface provided in the rim 44*a* and the surface projections 43*b*. This resulted in a transfer of energy to the particles in that region so as to induce a circular translational particle motion counter to the direction of eccentric gyration, as noted earlier. This motion is shown by the shaded arrows 47*a* in FIG. 7. (Particles are not illustrated in FIG. 8). Particles in the adjacent inner annular region, however, had a very much lower velocity of rotation, sometimes even in the direction of the eccentric gyration (as shown). The velocity of the circular motion (indicated by the white arrows 47*b*) in this adjacent region is thus negative relative to (i.e., less than) the counter eccentric velocity in the outer annular region.

As a result of the foregoing, a boundary (shown by the phantom line in FIG. 7) between these two velocity regions appeared to establish a natural barrier to the inward movement of the lead shot particles, even though the eccentricweights were set to provide an inward throw, or thrust, upon the particle mass as a whole. Thus, the denser particles tended to remain in the region of highest circular particle velocity. The densest particles (shown black in FIG. 8) thus displaced less dense (white) particles. The densest particles also had a tendency to migrate toward the surface of the bed. The reasons for this are not perfectly understood; however, this may occur because of their greater upward inertia provided by the upward thrust of the gyratory table element 43. It may also be the result of the small vertical gradient in circular velocity which increases from bottom to top of the bed. In any case, even those dense particles which may be present in the region inward of the barrier tend to move both to the surface and outwardly to the outer annular region adjacent the rim 44*a*. Advantage is taken of these phenomena in the extraction of the densest particles. To this end, the rim 44*a* includes one or more slots 44*e* cut into its upper edge through which particles in the upper stratum of the fluidized bed can flow into the collection zone 44*b*. This extraction path is shown by the shaded arrow 47*d*. From the channel 44*b*, the particles flow into the opening 48*a* and extraction duct 48*b*. While only one slot 44*e* has been illustrated, it is possible to provide further similar slots in the rim 44*a*, mutually spaced circumferentially.

Use of the extraction scheme shown in FIGS. 7–8 will result in some removal of less dense particles along with the densest particles; however, the extracted mixture is considerably upgraded, containing a much higher percentage of the desired dense material, for example, a particulate mineral. The upgraded material can, of course, be recycled through the same procedure for further upgrading, recycling taking place either in another stage (not shown) below that illustrated, or in a separate apparatus.

In FIGS. 7–8 less dense particles, displaced by the dense particles, migrated inwardly from the inlet opening 44*d* to the adjacent annular region from which they were removed, as follows:

As the volume of less dense particles in the adjacent region builds up, these particles reach the gap 45*c* at the collar 45 and travel to the collar's interior. There they are contacted by the collar surface 45*e* and are induced to rotate in the counter-eccentric direction (arrows 47*c*). Particles outside the collar 45 were forced inwardly into the higher (counter-eccentric) velocity flow (arrows 46*a*in FIG. 8). Once inside the collar, particles not only move circularly, but also flow upwardly toward the spout 45*d*, where they are extracted.

In review, particles of highest density accumulated and were extracted from the outer annular region next to the rim 44, while particles of less density moved inwardly in the adjacent region and eventually were extracted from the particle column bounded by the collar 45.

The theoretical explanation for the behavior of the particles is not entirely understood. It is believed, however, that the particles move in the fluidized bed under the influence of pressure differentials which are established by a combination of forces including those resulting from the circular translational motion, the inward thrust generated by the eccentric motion of the plate together with the apparently greater upward inertia of the more dense particles. Thus, in some instances, the particle motion seemed to comply with the laws of dynamic energy of motion. Whether the apparent highest relative velocity in the region of accumulation to dense particles is a causative factor of that accumulation or simply an observed phenomenon in this embodiment is not certain.

Where the particle bed has appreciable depth, the "hydrostatic" pressure also may be taken into account as in, for example, the interior of the column bounded by the collar 45. Dynamic pressure and the constant addition of dynamic energy to the particles by agitation are further factors tending to complicate the analysis. For example, if a strong inward momentum is imparted to particles at the rim 44*e*, a sufficient dynamic inward pressure may be exerted on all particles (including dense particles), and this could cause an undesired loss of some of the dense particles to the center of the bed in the FIGS. 7–8 arrangement. For this reason, it is desirable to adjust the dimension of the annular gaps below the collar 45, as well as the collar height, such that the flow into the particle column is gentle enough not to disturb the essentially circular flow at the bed's perimeter.

Although the configuration shown in FIGS. 7–8 represent one on a laboratory scale, using a 22 inch diameter table 43 driven by a ¾ hp motor (weights set at maximum amplitude) wherein the projections 43*b* extended inwardly approximately 2 inches from the rim and the collar 45 was 6 inches in diameter and set ½ inch from the table surface 43*a*, small lead shot admixed with sand resulted in almost 100% recovery of all lead shot with a flow rate through the apparatus of 2000 pounds per hour.

Certain further experiments with the apparatus revealed various facets of particle behavior, including their ability to separate in the fluidized bed. In one experiment a cylinder, similar to the collar 45 and about 4½ inches in diameter and 6 inches high, was fixed to the table 43 and filled with sand. A second, smaller cylinder of about 3 inches in diameter was inserted into the sand to a depth of four inches and r.p.m. readings were taken inside the sand. Within the smaller collar, the circular motion of sand measured about 10 r.p.m. (94 inches/minute at the periphery). In the two-inch space below the inserted collar the speed measured about 45 r.p.m. (636 inches/minute at the periphery). When lead shot was added to the sand, all the lead shot was recovered from the sand at the bottom of the fixed cylinder where the greatest velocity was present. When the inserted smaller coin was removed, the lead shot rose to the top one-quarter of the bed inside the cylinder.

Figure 5:
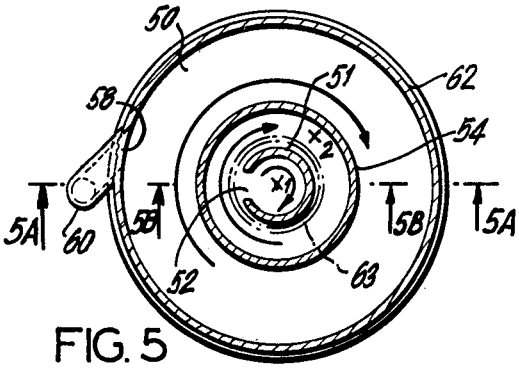
FIGS. 5 and 6 are respective plan section views of the apparatus of FIG. 1 showing different modifications thereof for carrying out various operations in accordance with the process of the invention.
Figure 6:
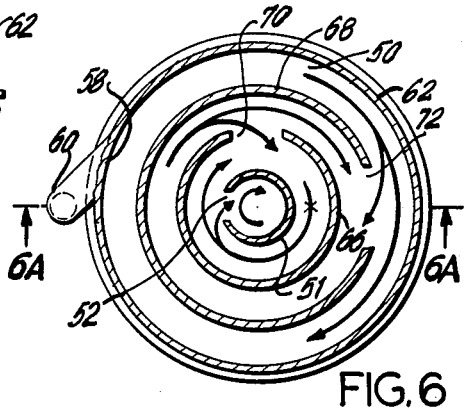

FIGS. 5 and 6 illustrate how further physical elements can be made to react with the particle bed so as to obtain controlled flow of the particle mass.

Figure 5B:
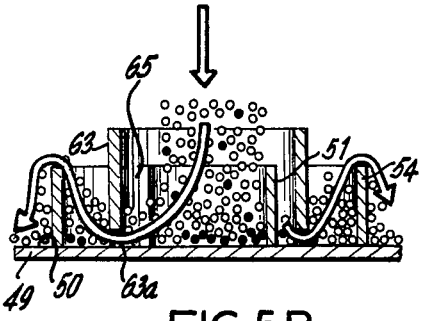
FIGS. 5A–5B and 6A are cross-sectional views, taken along the lines A—A and B—B of respective FIGS. 5 and 6, and include pictorial representations of particles for explaining how they are separated therein.
Figure 5A:
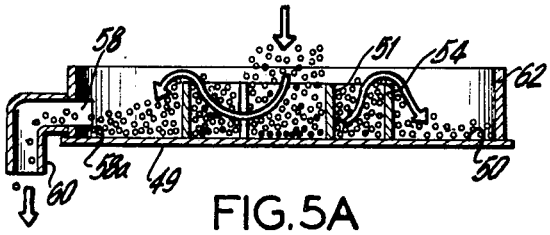

The plan view of FIG. 5 and the corresponding cross-sectional elevation view of FIG. 5A shows the location of flow controlling elements. A cylindrical collar or ring 51 extends upwardly from the center of the particle supporting surface 50. This collar has a vertical gap 52 extending down to the surface 50, such that particles are free to enter the region inside the collar 51 through the gap 52, but not underneath the collar as in the embodiments of FIGS. 7–8. A second collar in the form of an annular ring 54 radially spaced from the collar 51 likewise extends upwardly from the particle-supporting surface. It will be understood that the top surface 50 of the plate 49 bounded by the collars 51, 54 includes the annular grooves or ridges (not shown) of the type depicted in FIGS. 2A and 2B.

Particles are added to the particle bed either at the center of the open collar 51, as illustrated by the designation $X_1$ in FIG. 5A, or at the location designated $X_2$, which is between the collar 51 and the annular ring 54. Particles added to the particle bed at either location assume a circular motion both in the annular region at the interior of the ring 51 and in the annular region between the ring 51 and the ring 54, due to the eccentric gyratory motion of the surface 50 and rings 51, 54, which provide reaction surfaces to convert the particle spin energy into rotational translational energy of the particle mass.

Any denser particles which are in the annular region between the rings 51 and 54 will tend to migrate toward the interior of the collar 51, and will do so upon reaching the gap 52. Thus, there is an exchange of dense particles for less dense particles at the center of the fluidized bed, with the result that denser particles trade positions with the less dense particles and tend to remain there.

As more particles are added to the central portion of the particle bed, a point is reached when the less dense particles begin to overflow the impediment of the annular ring 54. These overflowing particles reach the annular region radially outside the ring 54 and, finally, the discharge opening 58 and the extracting spout 60. Thus a continuous flow may be established by adding particles continuously to the center of the bed, and extracting the overflowing less dense particles from the spout 60. For continuous flow operation the diameters of the rings 51, 54 are selected, as noted already, so as to maintain a higher rotational particle flow inside the ring 51 than in the region between rings. This flow relationship aids the tendency of particles to migrate toward the center of the bed where the dense particles may exchange position with the less dense particles and be collected. This inward migration that is aided by the circular flow relationship is caused by the angular displacement of the eccentric weight setting which, in all of the embodiments described herein, is 80°–90° lead to provide a net inward throw of the particles to the center.

The particle flow in the vertical plane from the central point, where particles are added, to the extraction spout 60 is seen in the illustration of FIG. 5A, the black particles representing the densest particles and the white particles representing less dense particles. In the drawings the more dense particles are shown to be resting at the bottom of the bed. This is a simplified case, and in practice the more dense particles may be suspended at levels below the surface due to the effects previously noted, namely, the greater upwards inertia given the dense particles.

In one embodiment, the various elements of the vibratory apparatus depicted in FIGS. 5 and 5A may have the following dimensions and characteristics:

| | |
|---|---|
| Collar 51 (diameter) | 4 inches |
| Opening 52 (width) | 1½–2 inches |
| Annular ring 54 (diameter) | 7 inches |
| Plate 49 (diameter) | 18 inches |
| Outer frame 62 (height) | As desired |
| Motor hp | ¼ |
| Motor rpm | 1140 |
| Weight lead angle | 80°–90° |

The configuration of FIGS. 5 and 5A was successfully used to obtain nearly 100% recovery in two minutes' time of 35 No. 2 lead shot from one gallon of sand ranging in particle size from between 1/16" and ⅛" diameter. The shot, after separation, was concentrated at the center of the fluidized bed in a volume of less than 5% of the volume of starting material added to the fluidized bed.

In the process which has been described, it is not absolutely essential that the annular regions defined by the rings be perfectly circular or that they have common centers. It should accordingly be understood that the term "concentric", as used herein, designates configurations wherein annular regions surround each other successively outwardly of the center of motion.

FIG. 5, in conjunction with FIG. 5B illustrates yet another arrangement of elements by which a different effect of the fluidized bed may be realized. In FIG. 5, the phantom lines represent a further annular ring 63 generally concentric with the open ring 51 and closely spaced to this ring so as to form therewith a narrow annular channel 65. The ring 63 extends only partially into the fluid bed so as to leave a narrow cylindrical gap between the bottom portion **63*a* of the ring and the surface 50 of the gyratory plate 49. Moreover, the ring 63 is not affixed to the table element 63, but is loosely held in place by suitable means or spacers (not shown). As a consequence, the ring 63 does not transmit energy to the particles; in fact, it extracts energy from and slows down the particles bounded thereby. Particles are added to the particle bed at the interior of the open ring 51** (at point $X_1$), as best seen in FIG. 5B.

The effect of the intermediate annular ring 63 is to induce a flow of the particles from the center of the ring 51, through the opening 52 in that ring, and thereafter underneath the intermediate ring 63 and into the annular region between the ring 63 and the ring 54. As before, denser particles tend to remain at the interior of the rings 51, 54. Less dense particles, nevertheless, are swept out through the opening 52, underneath the ring 63, and over the collar 54. When operated in this manner, the apparatus of FIG. 5 accommodates continuous feeding of particles to the particle bed at the center of motion and continuous extraction of the lighter (less dense) particles at the periphery of the particle bed.

The close spacing of the rings 51 and 63 (which may be in the range of 0.25"–0.75" when handling particles up to 0.25" in diameter) appears to slow considerably the circular particle motion in the channel 65. A reduction in the rotational velocity of particles inside the ring 51 is also observed when the ring 63 is inserted.

It is important to note that the floating ring 63 exerts yet another influence, and that is to slow down the particle velocity more at the upper level of the bed than at levels immediately above the surface 50. The most dense particles tend to remain within the collar 54 at the bottom of the fluidized bed rather than being caught up in the overflow and swept out into the adjacent region outside the collar 54. It is accordingly possible to control the velocity gradient vertically in the fluidized bed by such means as the floating ring 63 or other selective energy-extracting elements which contact the particles.

In FIG. 5B, as the spacing between the ring 63 and the surface 50 is increased, there is a concommitant lessening of drag and reduction of "pressure" in the annular channel 65; and a lesser rate of flow of particles from the interior of the ring 51 to the exterior of the ring 63 occurs.

At this juncture, it should be pointed out that the flow of particles in the bed can also be induced radially inwardly in the same manner. If, for example, the ring 63 were larger in diameter such that a narrow annular channel were formed adjacent the inner surface of the ring 54, particles would flow radially inwardly underneath the ring 63 and toward the center of the particle bed. It has been found that, with the configuration of annular rings shown in FIGS. 5 and 5B, reasonably good recovery of the densest particles is achieved.

Figure 6A:
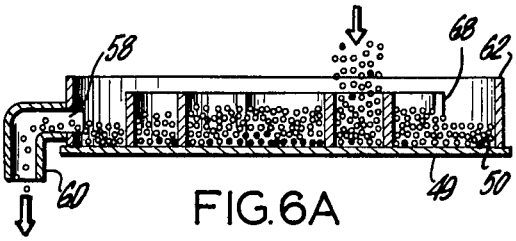

FIGS. 6 and 6A illustrate a different configuration of physical elements for controlling and directing particle flow. In this configuration also, a plurality of generally concentric annular regions is established between the concentric rings 51, 66 and 68; however, the entire surface 50 is provided with particle-reaction projections of one of the types represented in FIGS. 2A, 2B, 3A and 4A. In one embodiment which was found to be effective, the rings 66, 68 were dimensioned so that the circular particle velocity progressively increases from the outer to inner regions of the bed. The rings have respective openings in their vertical walls so as to permit radially inward migration of the particles in the fluidized particle bed. Thus, the ring 51 is provided with an opening 52, the ring 66 has an opening 70 and the ring 68 has an opening 72 through which the particles may flow. The arrows in FIG. 6 outline the general flow pattern of particles within the particle bed. As best seen in FIG. 6A, particles are continuously added to the particle bed in the annular region between the rings 51 and 66 (this location being designated by "X" in FIG. 6).

The arrangement of open rings of the foregoing configuration results in a circular motion of the particle mass within the annular region inside the ring 51, as well as within the regions between the rings 51 and 66, between the rings 66 and 68 and between the ring 68 and the outer frame 62.

In operation, with the configuration of elements shown in FIGS. 6 and 6A, the relatively dense particles tend to migrate inwardly. The more dense particles collect inside of the ring 51, whereas less dense particles are displaced in the particle mass radially outwardly through the respective openings 52, 70 and 72 into the outer annular regions. If desired, the height of the rings 66, 68 may be reduced in order to facilitate removal of the less dense particles by permitting them to flow over the top of these rings.

In one preferred configuration of elements following the arrangement of FIGS. 6–6A, five circular concentric rings were used. Each ring with the exception of the outer one, had a narrow vertical aperture serving an an area of communication between adjacent channels in the particle bed. The aperture in the center ring was ⅜" wide and 2" high; the apertures in the remaining apertured rings were ⅜" wide and 1½" high, as measured from the smooth floor of the plate 49. The dimensions of the rings were as follows:

| | Diameter | Height |
|---|---|---|
| Innermost ring #1 | 5 inches | 7 inches |
| Ring #2 | 7½ inches | 2 inches |
| Ring #3 | 9½ inches | 2 inches |
| Ring #4 | 11 inches | 2 inches |
| Ring #5 | 12 inches | 2 inches |

The inter-ring spacing (i.e., transverse channel dimension) thus progressively increased from the outer periphery to the inner ring as follows: ½ inch, ¾ inch, 1 inch, 1¼ inches.

In several tests using a batch of 100 pounds of −30+15 mesh silica sand containing a few grams of 0.11 inch diameter lead shot, more than 90% of the lead shot was collected and recovered in less than 10 pounds of sand in the region inside the center ring, using a test flow rate (rate at which sand/lead shot mixture is added to the particle bed) of 30 pounds per minute.

The sand/lead shot mixture was added at the point illustrated in FIGS. 6–6A. To facilitate the addition of the particle mixture at this point, a narrow apron, extending horizontally from the center ring at a height of 2½" above the plate 49, was used to break the fall of particles into the particle bed. Means may be used to guide the particles onto the apron as, for example, a cylindrical collar affixed to and spaced outwardly from the center ring.

In this five-ring embodiment, the mode of operation and the manner of separation occurred as described in connection with FIGS. 6–6A. The circular velocities of particle flow, however, were difficult to measure. There was an apparent counter-eccentric particle flow in the channels at lower levels of the particle bed, to the extent that flow could be measured with a probe thrust into the bed. However, the surface of the particle bed in the channels between rings exhibited considerable agitation, or turbulence, and no reliable velocity measurement could be made. In the center ring, however, there was a counter-eccentric circular motion that was observably faster than the apparent circular velocity in the channel adjacent this ring.

During operation, the apertures in the rings were below the surface of the particle bed, and less dense particles flowed radially outwardly over the tops of the 2-inch high rings for continuous extraction of the less dense particles from the region defined between the non-apertured 12-inch ring and the rim 62.

To achieve the rate of separation specified above, a "Kason" vibratory machine (similar to FIG. 1 was equipped with a ⅓ hp motor operating at 1140 r.p.m., and with a weight setting of 90° lead loaded to capacity of the machine.

Thus, in the embodiments of FIGS. 6, 6A, it will be seen that the flow of particles is generally radially inward. The migration of particles is restricted between adjacent annular regions except at peripherally displaced openings (72, 70, 52) between these adjacent regions. This configuration forces particles migrating within the fluidized particle bed from one annular region to another annular region to follow a circular path before reaching an opening interconnecting adjacent regions. As a result, the particles are given a longer residence time in the fluidized bed and, consequently, the more dense particles have adequate time to separate out as they travel progressively inwardly.

Figure 9:
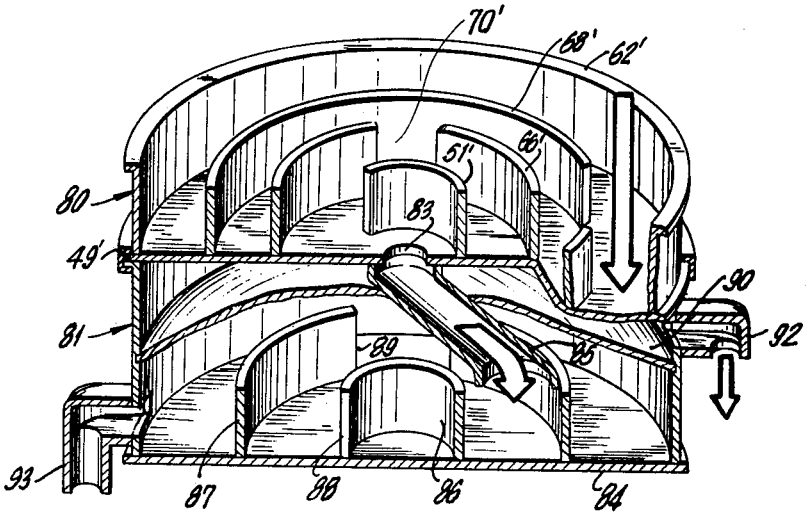
FIG. 9 is a perspective view in partial cross-section of a two-stage separation apparatus for separating particles by density in accordance with the invention.

The process of the invention is ideally suited not only for separating particles in a single operation, but also for separating particles in separate stages. One apparatus in which multi-stage separation can be accomplished is illustrated in FIG. 9. There, two separation stages 80, 81 are vertically superimposed so as to be agitated by a common eccentric agitater of the type described above in connection with FIG. 1. The first stage is comprised of the elements shown in FIG. 6 and like numerals (followed with a prime mark) have been assigned to the various elements. In addition, the upper stage 80 is provided with a central opening 83 through the plate 49' for passing the separated heavy particles to a chute 85 leading to the second (lower) stage 81, this stage including a pair of concentric rings 86, 87 extending upwardly from the bed-supporting plate 84 having circumferentially spaced vertical gaps 88, 89 similar in configuration and location to the rings 51, 66 in FIG. 6. Though not shown in FIG. 9, the central opening should be provided with a flow restrictive element such as a low standpipe or collar such as shown in FIG. 8. Separation in the two stages takes place as described above in connection with FIG. 6.

In order to extract the scalped waste material from the first stage, a domed plate 90 disposed underneath the plate 49' receives less dense particles discharged from the openings through the plate 49' and leads them to the discharge spout 92. As clearly illustrated, the chute 85 passes through the sloping plate and deposits the more dense particles from the first stage in the annular region between the rings 86, 87. The less dense particles and waste material from the second stage exit from the lower discharge spout 93.

It will be understood that combinations of stages other than that shown for illustrative purposes can be effectively used, and that further separation of the extracted less dense materials can be similarly effected in the same manner in a second stage of separation. Moreover, it is preferable that all particles in the particle bed be classified beforehand so that an evenness of particle size is obtained. This ensures that dense particles to be separated will have greater mass than the less dense particles. To that end, apparatus for carrying out the process may incorporate conventional separation screens.

Although the invention has been described with reference to specific processes and apparatus which have been carried out successfully on a small scale using experimental apparatus, it should be understood that the process is not limited to any specific apparatus for carrying out the invention. There are numerous ways in which a fluidized bed might be controlled for separating particles of specified relative density by the use of specially designed elements placed within the fluidized bed. For example, the flow-controlling elements might be made sloping and may take forms other than those disclosed herein to fit particular needs. Additionally, the bed-supporting surface need not be perfectly planar, and might have the form of an inwardly or outwardly sloping conical wall, or yet other types of sloping geometrics for taking advantage of gravitational force on the particle mass. As a further example, the bed-supporting plate can be covered with a resilient layer which can be depressed slightly by the weight of the particles thereon so as to obtain the desired conversion of spin into translational circular particle movement.

It should also be noted that while the invention is ideally suited for separation in a dry particle bed, i.e., on e in which no supplemental fluid flow is required, separation can be effected though the particle surfaces are wetted as long as particle mobility is not eliminated by such wetting. Furthermore, the term "particle" herein is not used in its strictly literal sense and does not necessarily connote minute or small particles, since the invention might be applied to separation and classification of fragmentary materials over a great range of sizes including stone, rock and minerals (e.g., coal) in chunk form. It should be understood that where the term particle velocity is used, reference is being made to the velocity at levels below the surface of the particle bed. In some instances, for example, particles on the surface appear to flow in a direction opposite to particles below the surface.

No attempt has been made to suggest all foreseeable modifications and variations which might occur to those skilled in the art. Thus, for purposes of explanation, all embodiments and operative process modes described above have employed vibratory machines wherein the eccentric weights were set to provide a substantial lead angle. But other weight settings can be used. Thus I have also used a 0° lead angle to achieve separation. In that case the dense particles collected in the outermost channel at the periphery of the particle bed. Circular velocity of the particles could not be measured, and it is quite possible that the particles were influenced more by the net radially directed thrust imparted to them by the eccentric component of gyratory motion than by any forces the circular velocity may have exerted. All such modifications and variations are intended to be encompassed by the appended claims.

What I claim is:

1. In a process for the separation of particles of selected density from an aggregated mass of classified particles having different densities, the steps comprising:

disposing the aggregated mass of particles upon a supporting surface to form a particle bed;

laterally confining the particles in the bed with vertical reaction surfaces movable with the supporting surface so as to establish at least one annular region containing the fluidized particles;

providing an annular intermediate reaction surface between adjacent vertical reaction surfaces so as to form at least two adjacent annular channels, said intermediate reaction surface being movable independently of said vertical reaction surfaces;

providing a restricted area of communication through the boundary defined by said intermediate reaction surface;

agitating the supporting and reaction surfaces with a gyratory motion having a circularly eccentric component and an oscillatory vertical component, said motion being such as to fluidize the particle bed and thereby reduce the resistance of the particle bed to translational movement of the particles therewithin, and to induce a net radial movement within the annular channels of particles of selected density; and permitting said particles of selected relative density to pass through said restricted area of communication by virtue of said radial movement so as to establish particle flow from one of said adjacent annular channels to the other.

2. The process of claim 1 wherein said restricted area of communication is a gap defined between the bottom portion of the intermediate reaction surface and the supporting surface.

3. In an apparatus for separating particles of selected relative density from an aggregate mass of classified particles having different densities, the combination of:

means providing a surface for supporting the aggregated mass of particles constituting a particle bed;

means supporting said surface means for at least limited lateral and vertical motion:

means for agitating said supporting surface with a gyratory motion having a circularly eccentric motion component and an oscillatory vertical motion component sufficient to fluidize the particle bed and thereby substantially reduce the resistance of the particle bed to translational movement of relatively more dense particles therewithin:

reaction surface means associated with the supporting surface defining an annular region, said reaction surface means and supporting means providing an area of frictional contact with the particle bed sufficient to energize the relatively more dense particles so as to cause them to move through the bed in paths having a net radial component;

intermediate surface means defining with said reaction surface means at least two adjacent annular channels for fluidized particles, said intermediate surface means being movable independently of said reaction surface means; and said intermediate surface means defining a restricted area of communication between adjacent annular channels and being so configured to permit said relatively more dense particles to pass through the boundary defined thereby from one adjacent channel into the other.

4. The apparatus of claim 3, wherein said restricted area of communication is a gap defined between the lower portion of said intermediate surface means and said supportive surface.

* * * * *